US005992123A

United States Patent [19]

Kies

[11] Patent Number: 5,992,123

[45] Date of Patent: Nov. 30, 1999

[54] SHEAR STUD ASSEMBLY AND METHOD FOR REINFORCEMENT OF COLUMN OR BEAM CONNECTIONS

[75] Inventor: Antonius M. Kies, Oisterwijk, Netherlands

[73] Assignee: Erico International Corporation, Solon, Ohio

[21] Appl. No.: 08/895,375

[22] Filed: Jul. 16, 1997

Related U.S. Application Data

[60] Provisional application No. 60/022,154, Jul. 19, 1996.

[51] Int. Cl.[6] ..... E04C 5/16; E04B 1/00

[52] U.S. Cl. ..... 52/719; 52/251; 52/260; 52/334; 52/414; 52/742.1

[58] Field of Search ..... 52/710, 719, 742.1, 52/442.2, 729.1, 729.2, 729.3, 334, 251, 252, 259, 260, 261, 414, 649.2, 698, 699; 411/84, 85

[56] References Cited

U.S. PATENT DOCUMENTS

| | | | |
|---|---|---|---|
| 992,877 | 5/1911 | Kahn | 52/710 X |
| 2,112,480 | 3/1938 | Coddington | 52/724 X |
| 2,558,946 | 7/1951 | Fromson | 52/334 X |
| 3,456,706 | 7/1969 | Ollis, Jr. | 411/84 X |
| 3,535,846 | 10/1970 | Storch | 52/698 |
| 4,406,103 | 9/1983 | Ghali et al. . | |
| 4,612,747 | 9/1986 | Andra et al. . | |
| 4,708,612 | 11/1987 | Pape . | |
| 5,134,824 | 8/1992 | Guazzo | 52/724.2 X |
| 5,655,349 | 8/1997 | Ghali et al. | 52/724.1 |

FOREIGN PATENT DOCUMENTS

| | | | |
|---|---|---|---|
| 2727159 | 12/1978 | Germany . | |
| 4227056 | 2/1994 | Germany | 52/724.1 |

OTHER PUBLICATIONS

Embedment Properties of Headed Studs TRW Nelson Division; TWR Inc. 1975.

E. Reyer; Zur Konstruktion lochrandegestutzter Platten Bauingenieur 57 (1982) 11–17; Springer–Verlag 1982.

Elgabry, et al.; Design of Stud–Shear Reinforcement for Slabs ACI Structural Journal, V. 87, No. 3, Title No. 87–S35; May–Jun. 1990.

Megally, et al.; Design Considerations for Slab–Column Connections in Seismic Zones ACI Structural Journal, V. 91, No. 3, Title No. 91–S30; May–Jun. 1994.

Decon Studrails brochure, undated.

Deha Andersysteme, Stud Rail, DBP, Patents Worldwide, Technical Guide–Lines Deha, Baubedarf GmbH & Co., KG, brochure number D111E, undated.

Durchstanz–Bewehrung HDB, System acnoPLUS Halfen brochure, undated.

"Nelson Stud Welding" by Division of Gregory Industries, Inc., Oct. 1959.

*Primary Examiner*—Carl D. Friedman
*Assistant Examiner*—Winnie S. Yip
*Attorney, Agent, or Firm*—Renner, Otto, Boisselle & Sklar P.L.

[57] ABSTRACT

A shear stud assembly is formed at the construction site by assembling double-headed shear studs with a channel system which engages one-headed end of the shear studs. The shear stud assembly may be positioned in a slab, beam, or horizontal element around columns or vertical elements for reinforcement with the studs hanging downwardly from the channel system through the normally congested steel reinforcing. Several forms of channel system are disclosed, each of which permit the length of the assembly and the spacing of the studs to be adjusted to fit, and yet still remain within the design parameters, all without the use of skilled labor or special tools.

27 Claims, 2 Drawing Sheets

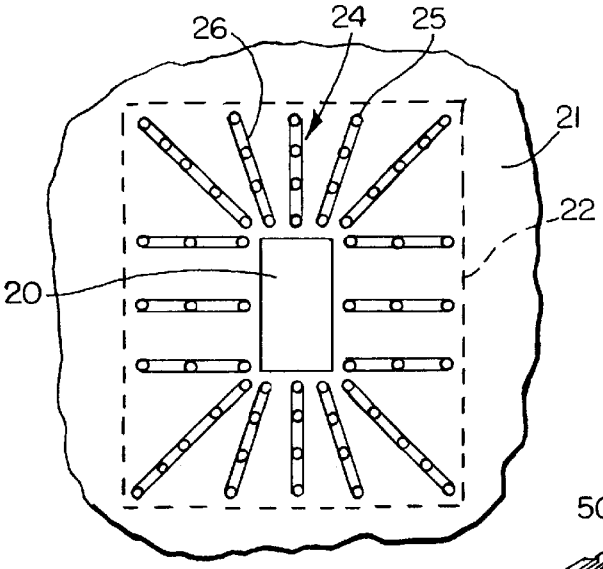
FIG. 1
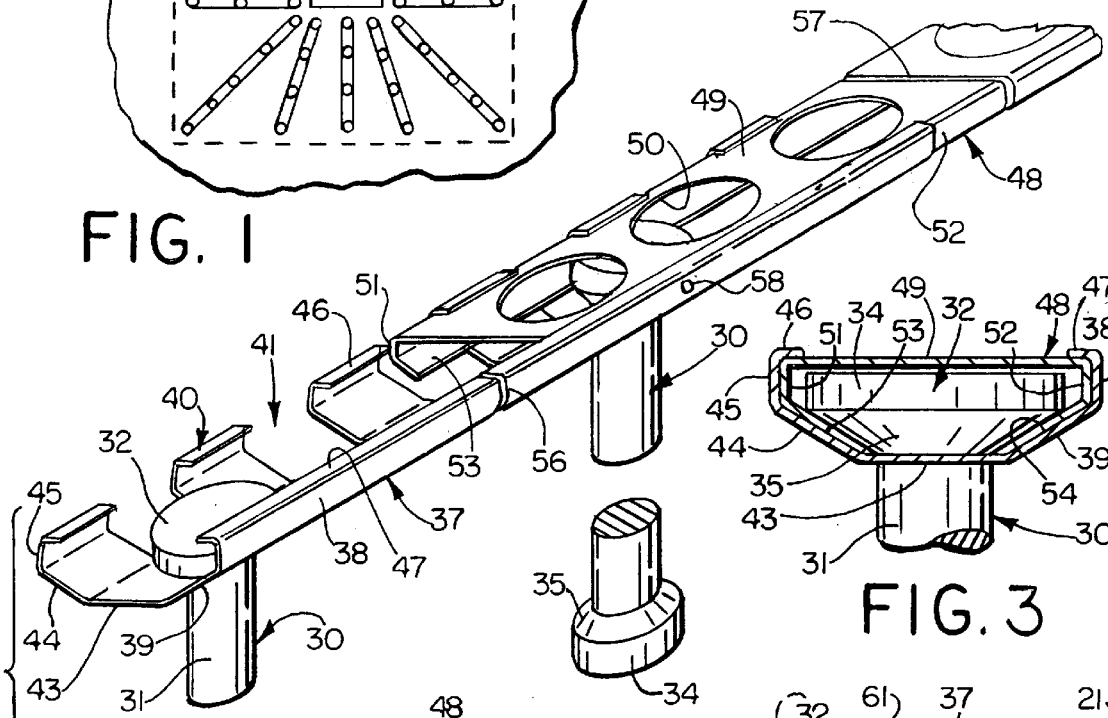
FIG. 2
FIG. 3
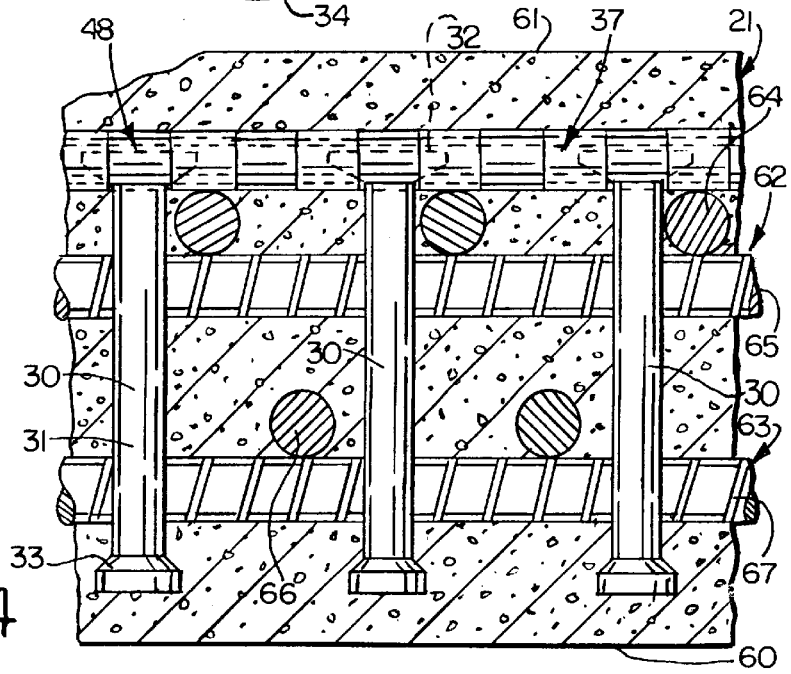
FIG. 4

SHEAR STUD ASSEMBLY AND METHOD FOR REINFORCEMENT OF COLUMN OR BEAM CONNECTIONS

This application is a Provisional application Ser. No. 60/022,154, filed Jul. 19 1996.

DISCLOSURE

This invention relates generally as indicated to a shear stud assembly and method for reinforcement of column or beam connections in steel reinforced concrete construction.

BACKGROUND OF THE INVENTION

A common steel reinforced concrete building or structure form is a horizontal flat slab or plate supported by vertical columns or beams and the like. Because of the transfer of shearing forces and moments, such structures can be subject to brittle punching failures which are manifested by cracks extending as an inverted cone or pyramid through the slab, beam, or plate at the supporting column or beam. The cracks extend at their lower end from the tensile area of the slab or beam to the compressive area or top.

Adequate strength, drift capacity and ductile behavior can be obtained by increasing the slab thickness in the area of the column or beam or providing the column with a shear capital or enlargement at the top. These solutions, however, are costly and space consuming. A more cost effective approach is to provide the horizontal element around the column or at the beam with shear studs or stirrups. Shear studs are relatively short rods which have an upset or enlarged head at one or both ends. The use of separate or individual shear studs is rare because they can be loose during the pour and the heads or ends have to be spaced from the top and bottom of the slab. If supported from a bottom form for the slab, a chair is usually required.

Present practice consists of single or double headed studs connected at one end by a steel strip, rail or rod to hold and position the studs as an assembly for positioning in the slab formwork around a column. The rail or rod is connected along the top or bottom of the studs and most commonly by shop fabrication welding. Examples may be seen in U.S. Pat. Nos. 4,406,103 and 4,612,747. Thus, the shear reinforcement assemblies are part of the steel reinforcing design and such are delivered to the job site already assembled or fabricated. The assembly may be quite heavy, bulky, and unwieldy. One of the major problems with the use of such factory formed shear stud assemblies is that they will not fit the area of intended insertion because such area is already heavily congested with steel reinforcing. In the design of steel reinforcing tolerances are measured in centimeters (cm), and though the shear stud assembly may fit on the drawing board or in the computer graphics, it simply will not go where it is supposed to go, at least without considerable banging or reworking of the steel reinforcement, or refabrication. Sending it back to the shop with a pour already scheduled is usually out of the question. The difference between installation drawings and field conditions and practice is often significant. The force fit of prefabricated assemblies often produces results less optimal than as originally designed.

SUMMARY OF THE INVENTION

The present invention utilizes double headed shear studs which may be shipped to the construction site in bulk and assembled at the site at field adjustable spacing to a channel system. The length of the assembly, the number of studs in the assembly, and the spacing of the studs along the channel system of the assembly may quickly be set at the exact location at the site where the assembly will be installed in the formwork. All of this can be quickly accomplished by unskilled labor without special tools such as welding or cutting equipment. When assembled, the channel system rests on top of the steel reinforcement around the column with the studs projecting downwardly toward the bottom of the slab but spaced from the form forming the bottom. The system allows the use of double headed shear studs to achieve maximum strength.

Several forms of channel systems are disclosed. One uses a notched or finger template channel to receive the stud shank and control the spacing of the studs which are locked in place by sliding a locking channel over the stud head within the finger channel. A second embodiment uses a channel with serpentine short legs forming a neck with sockets which deform for stud movement along the channel, but which confine the stud shank when the selected position is obtained. Another form uses flexible or deformable channel walls allowing the stud to be slid in and then pulled axially to deform the walls to snap into a position where the walls frictionally grip the stud head.

The method comprises the steps of shipping the components to the construction site in bulk and then assembling the components to achieve the desired length and spacing of the studs in the assembly, all for ease of installation and optimal reinforcement.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

FIG. 1 is a broken top plan view of a slab or deck at a column illustrating an exemplary arrangement of shear stud assemblies in the area of punching failure cracks;

FIG. 2 is a fragmentary isometric view of one form of the invention with the double headed studs positioned along the channel assembly, spaced by a finger channel and being held in place by a sliding locking channel;

FIG. 3 is an enlarged fragmentary transverse section illustrating the upper stud head in the assembled channels;

FIG. 4 is a fragmentary section vertically through the slab illustrating the assembly in elevation and showing one spacing;

DETAILED DESCRIPTION OF THE PREFERRED EMBODIMENTS

Figure 5:
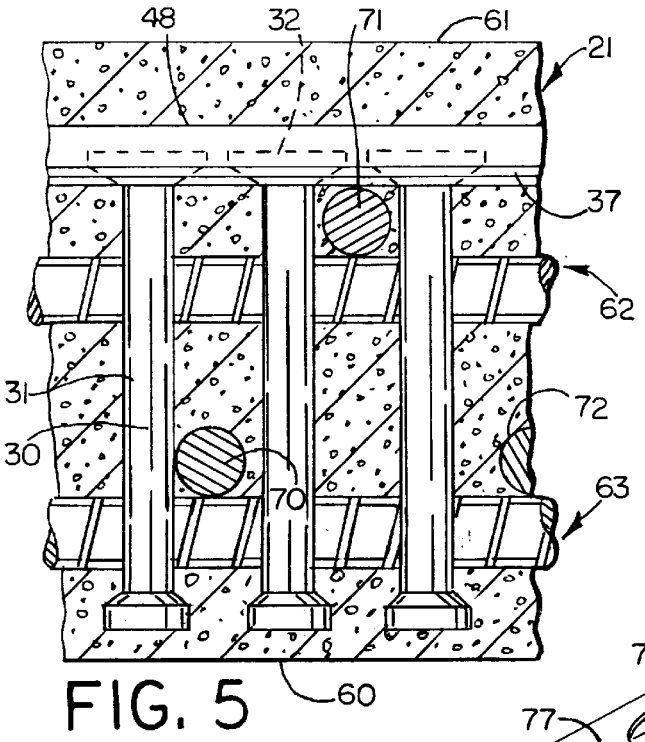
FIG. 5 is a similar view showing another spacing.

Referring initially to FIG. 1, there is illustrated a rectangular column 20 supporting a slab or deck 21 which extends horizontally from the column. The rectangular area indicated by the dotted lines 22 is the area of potential punching failure cracks. As indicated, such cracks normally extend inclined upwardly from the tensile area of the slab or deck at the column to a substantially enlarged area in the top or the compressive area of the deck or slab. This zone would be in the form of an inverted pyramid and the rectangular dotted line area 22 represents the maximum base of that pyramid. It is within the zone 22 around the column 20 within the deck or slab 21 that a plurality of shear stud assemblies indicated at 24 are provided. They extend within the reinforcement of the deck or slab generally radially of the column. Each assembly 24 comprises a plurality of vertically extending shear studs 25 assembled as a unit preferably along the top of the studs by a channel or channel assembly 26.

It is noted that the shear stud assemblies 24 arranged in a radiating fashion through the zone 22 may vary in length and also in the number and spacing of the shear studs. As illustrated in FIG. 1, some have as many as five studs, some have as many as four studs, and others have only three studs. With the various embodiments of the present invention, it is possible quickly to assemble the shear stud assemblies at the column-slab site to form not only the length of shear stud assembly desired, but also the number and spacing of the shear studs within each assembly. What is not shown in FIG. 1 is the steel reinforcing and/or tendons used in the construction of the steel reinforced concrete structure, which, in the area of the column-slab connection, is particularly congested.

Referring now to the embodiment of FIGS. 2, 3, 4 and 5, there is illustrated a shear stud assembly which includes a plurality of vertically extending double-headed studs 30, each of which includes a shank 31 and enlarged or upset heads 32 and 33, one at each end. The heads may be formed in an upsetting machine by cold forging. Each head includes a cylindrical outer portion 34 and a relatively shallow conical section 35. The stud may vary in length and the length of the stud depends upon the vertical depth of the slab or deck in which the stud will be positioned. The diameter of the shank of the stud may vary considerably and may normally have sizes similar to that of the reinforcing bar.

It will be appreciated that the studs may be shipped to the construction site, and within the site of construction to the particular column-slab or other connection construction location in bulk. At the site, the studs are assembled with a finger channel shown generally at 37. The finger channel has a continuous upturned side 38 which is joined to a continuous inclined side 39. From the longitudinally continuous portions of the channel extend fingers seen at 40 which form notches 41 therebetween. The fingers include a horizontal section 43, an upwardly inclined section 44, and an upturned side 45. Both the separate finger sides 45 and the continuous side 38 include short inturned top edge flanges as seen at 46 and 47, respectively. The finger sections and flanges correspond with and are symmetrical to the inclined and vertical sections and flanges on the opposite side of the channel. As can be seen in FIG. 2, the notches 41 are slightly wider than the shank 31 of the stud and the stud head 32 nests in the upwardly opening pocket formed by the finger channel configuration.

In order to secure the studs in place in the selected notches, a locking channel shown generally at 48 is slid over the heads 32 of the studs as indicated in FIG. 2. The locking channel includes a backwall 49 provided with relatively large circular holes 50 which prevent air pockets from forming within the assembly when the concrete is poured. In addition, the locking channel includes relatively short side walls 51 and 52 which terminate in inwardly inclined side wall edges 53 and 54. As seen in FIGS. 2 and 3, the dimensions of the locking channel are such as to embrace the stud heads 32 and yet telescope within the trough or pocket formed by the finger channel, with the inclined wall edges 53 and 54 sliding beneath the stud heads 32. The gap between such edges readily accommodates the shank 31. When fully assembled, the stud heads cannot be removed without sliding the locking channel out.

As noted in FIG. 2 at 56 and 57, both the finger channel 37 and the locking channel 48 may be provided with design weaknesses so that the channels may be broken apart into the lengths desired. In this manner, the channels may be shipped to the construction site in a package much like a shipment of two by fours and then at the construction site, easily manually broken into channels of the desired length. It should be kept in mind that the channels are relatively thin gauge metal material and that other than positioning the studs correctly for the pouring of the concrete, they have little or no structural requirement. The design weaknesses 56 and 57 may be in the form of an attenuation, a perforation, or simply a groove or crease to create a bend point so that a few flexures of the channel at the design weakness will cause the sections to separate. They may be on approximately 5 cm centers. Also, the channels may have fixing holes on 25 cm centers, for example, as shown at 58 to enable the channels readily to be secured together when assembled.

As illustrated in FIG. 5, the studs may be positioned in adjacent notches 41 to achieve a relatively close spacing. In FIG. 4, the studs are spaced in every other notch. In FIG. 2, the two studs illustrated are separated by two notches. Accordingly, the spacing of the studs along the channels may vary considerably.

Referring now to FIG. 4, there is illustrated the deck or slab section 21 surrounding the column. The deck or slab is formed on a form which forms the bottom indicated at 60. The top of the slab is seen at 61. The slab illustrated includes two vertically spaced layers of reinforcing seen at 62 and 63, each of which includes overlapping bars extending at essentially right angles to each other. The layer 62 includes bars 64 normal to the plane of the figure and bar 65 parallel to the plane of the figure. Similarly, the layer 63 includes bars 66 normal to the plane of the figure and bar 67 parallel to the plane of the figure. In conventional practice, the bars may be wired tied where they lap. Although the spacing of the bars is supposed to be generally uniform, the exact location may vary widely, and the exact location of the reinforcing may be an impediment to positioning the shear stud assembly. After the shear stud assembly is completed as seen in FIG. 4, the assembly is simply placed on top of the upper layer 62 with the shear studs 30 hanging downwardly through the two layers of steel reinforcing. The assembly may be wire tied in place. In such position, the lower stud head 33 is spaced substantially from the bottom of the slab, or the top of the form, and the upper head 32 is spaced substantially below the top surface 61 of the slab. The finger channel and the locking channel simply support the studs as an assembly to hang through the reinforcing bar layers as seen in FIG. 4. No permanent form of attachment is required, and no chairs or stools are required to space the assembly from the forms.

FIG. 5 illustrates much the same deck with a slightly different spacing of the steel rods in the reinforcing layers 62 and 63. In FIG. 5 as indicated, the studs are supported in adjoining notches, and at least in the area illustrated, are quite close together. The spacing may be determined by design or, it may be determined by necessity since in the area illustrated, only the adjacent notch spacing illustrated will permit the studs 30 to fit through the rods indicated at 70, 71 and 72. If the installer finds that the position of one stud will not fit through the steel reinforcing congestion, the assembly may quickly be reassembled with that stud shifted along the channel.

Figure 7:
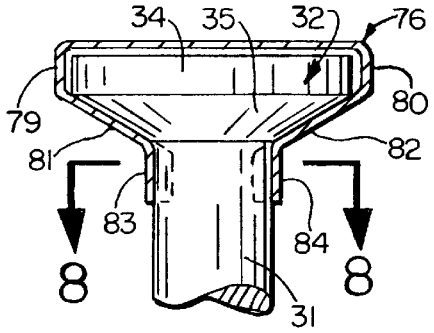
FIG. 7 is a transverse section of the channel of FIG. 6 showing the neck gripping the shank.
Figure 6:
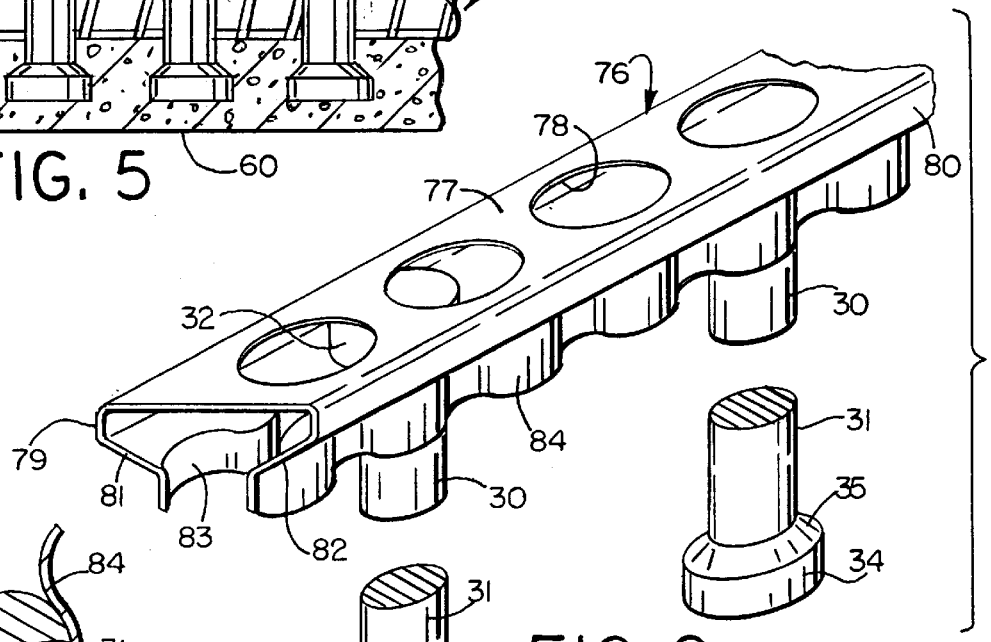
FIG. 6 is an isometric of another embodiment utilizing a channel with neck sockets for grasping the shank of the adjustably positioned studs which are shown broken away.
Figure 8:
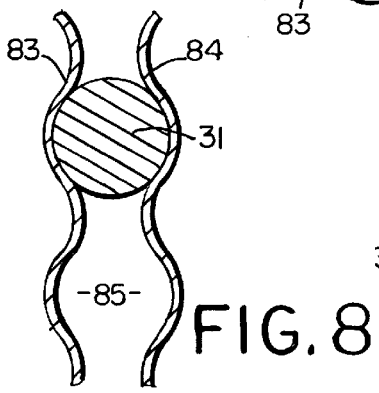
FIG. 8 is a section through the neck and shank taken from the line 8—8 of FIG. 7.

Referring now to FIGS. 6, 7 and 8, there is illustrated a single channel embodiment of the present invention. The single channel is illustrated at 76 and includes a back 77 with relatively large holes 78 to avoid air entrapment in the concrete. The channel includes two relatively short side walls 79 and 80 which join inclined walls 81 and 82, respectively, which terminate in generally parallel yet serpentine neck walls 83 and 84, respectively. The channel 76 is made of relatively thin sheet metal and has some degree of flexure to it, with the greatest degree of flexure being between the serpentine neck walls 83 and 84. As seen more clearly in FIG. 8, the serpentine walls form relatively closely spaced sockets 85 which will grip and retain the shank 31 of a stud. Because of the flexure in the channel system, a stud may be moved longitudinally of the channel and snapped into a selected socket 85. In such socket, the serpentine neck walls will grip the shank immediately interiorly or below the head 32, with the head being accommodated in the corresponding profile configuration of the channel. Again, the channel may be provided with the break apart feature enabling the channel to be separated into the desired lengths from longer lengths which are shipped to the construction site. At the construction site, the channel length selected may quickly be assembled with the number of studs and the spacing of such studs selected. The shear stud assembly formed will be supported through the steel reinforcing in the same manner as seen in FIGS. 4 and 5, with the channel 76 on top of the upper layer of reinforcing.

Figure 11:
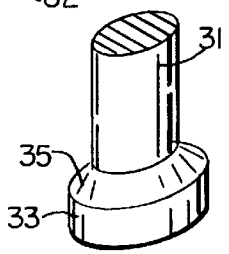
FIG. 11 is a similar view showing the stud head frictionally grasped by the channel wall after being pulled axially of the shank with respect to the channel.
Figure 11:
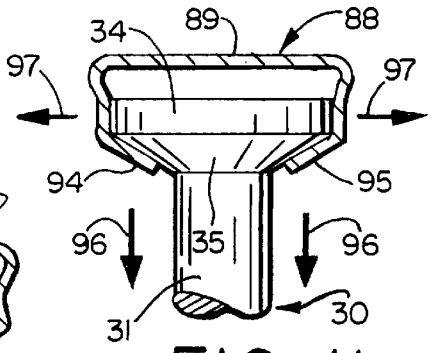
Figure 9:
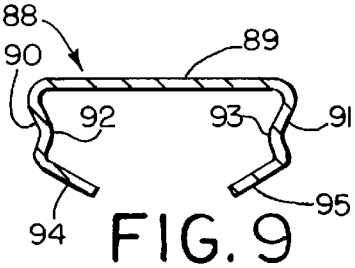
FIG. 9 is a transverse section of a snap-in embodiment channel.
Figure 10:
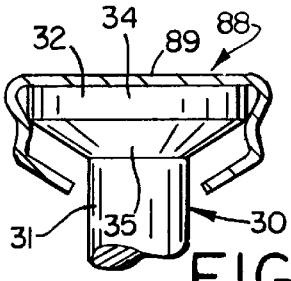
FIG. 10 is a transverse section of the embodiment of FIG. 9 with the stud inserted in the channel but not secured.

In FIGS. 9, 10 and 11, there is illustrated another embodiment of the present invention. The embodiment comprises a single channel 88 which includes a perforated back 89 and side walls 90 and 91, each of which include an inwardly projecting shoulder as seen at 92 and 93, respectively. The side walls terminate in inwardly sloping edge termination walls 94 and 95, respectively.

With the configuration of the channel of FIGS. 9–11, when the channel is slipped over the stud head as seen in FIG. 10 with the stud head flush against the inside of the channel back 89, the configuration of the side walls is such that the stud is free to slide longitudinally of the channel. However, when the stud is in the selected position, it is simply pulled axially as indicated by the arrows 96 in FIG. 11. The cylindrical portion 34 of the stud head engages the shoulders 92 and 93 causing the side walls to flex and snap outwardly slightly separating and firmly gripping such cylindrical portion 34 of the stud head. The conical portion of the stud head indicated at 35 engages the channel leg terminations 94 and 95.

Accordingly, axial movement of the stud in the direction of the arrows 96 causes the side walls to separate in the direction of the arrows 97, deforming the side walls, and frictionally gripping the stud head. The gripping of the stud head is sufficient to form the assembly at the desired length and stud spacing. As in the FIG. 6 embodiment, the channel of the embodiment of FIGS. 9–11 has the structural weaknesses at certain centers for break apart purposes.

The channels of the various embodiments are preferably spring steel, about 0.57 mm in thickness, and may be roll formed and punched. Afterwards, they may be heat treated and coated.

It can now be seen that there is provided a stud head assembly which is not only easy to fabricate, but easy to install. With the present invention, the stud distance can be set and fixed at the job site so that the stud arrangement readily accommodates the steel reinforcing. No tools or weld equipment, or trained operators are necessary to assemble the studs for the designed and/or necessary distance for installation. The ability to ship both the studs and the channels to the construction site in bulk greatly facilitates the construction process avoiding unwieldy and bulky prefabrication procedures, shipments, and field adjustments or refabrications where shop fabricated assemblies simply will not fit. The double-headed shear stud achieves maximum strength without any welding either at the shop or at the construction site. The strength of studs is often adversely affected by welding or the weld itself may be suspect.

With the present invention, the practicalities of installation can more readily be adapted within the required design parameters.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A reinforcement combination with vertical-horizontal poured-in-place concrete element connections in steel reinforced concrete structures comprising a horizontal rail extending horizontally from a vertical concrete element within a form of a horizontal concrete element, a plurality of headed studs projecting from the rail, and means to assemble and adjust the position of the studs along the rail at the construction site to accommodate the steel of the steel reinforcing within the form before the concrete is poured to embed the reinforcement in the horizontal concrete element at the vertical concrete element.

2. The reinforcement combination set forth in claim 1 wherein each stud is headed at both ends with a shank therebetween.

3. The reinforcement combination set forth in claim 2 wherein said rail comprises channel means.

4. The reinforcement combination set forth in claim 3 wherein said channel means comprises a finger channel and a locking channel assembly operative to engage and space the studs therealong.

5. The reinforcement set forth in claim 4 wherein said finger channel includes fingers which embrace the head on one end of a stud with the shank fitting between said fingers.

6. The reinforcement combination set forth in claim 5 wherein said locking channel slips over the head on said one end of the stud and has an opening to accommodate the shanks of said studs.

7. The reinforcement combination set forth in claim 6 wherein said fingers of said finger channel are equally spaced forming notches accommodating the shank of the stud.

8. The reinforcement set forth in claim 7 wherein the adjustment of said means to assemble and adjust is obtained by placing the studs between selected fingers with the locking channel removed.

9. The reinforcement combination set forth in claim 7 including means to fix the locking channel to the finger channel to unitize the reinforcement for handling and placing.

10. The reinforcement combination set forth in claim 3 including field break points spaced along said channel to field form the length desired.

11. The reinforcement set forth in claim 3 wherein said studs have tapered heads, and said channel means conforms to said taper.

12. The reinforcement combination set forth in claim 3 including openings in said channel means to permit concrete fully to penetrate said channel means when assembled on the studs.

13. The reinforcement combination set forth in claim 3 including serpentine legs on said channel means forming spaced pockets adapted to grip the shank of the studs.

14. The reinforcement combination set forth in claim 13 wherein said channel means has side walls conforming to the stud head and terminating in such serpentine legs.

15. The reinforcement combination set forth in claim 14 wherein said channel legs are adapted to spring apart whereby a stud may be positioned in a selected pocket with the serpentine legs gripping the stud shank adjacent a stud head accommodated in the channel means.

16. The reinforcement combination set forth in claim 3 wherein said channel means includes side walls providing clearance for a stud head in one position of the stud with respect to the channel, and frictional interference with the stud head in another position of the stud with respect to the channel.

17. The reinforcement combination set forth in claim 16 including snap side walls on said channel means operative to grip the stud head when the stud is pulled axially of said channel.

18. The reinforcement combination set forth in claim 16 including inwardly directed shoulders on said side walls operative to engage the stud head as it is pulled axially of the channel to deform the side walls frictionally to grip the stud head.

19. A method of forming a vertical-horizontal concrete element steel reinforced concrete connection in poured-in-place concrete structures comprising the steps of including in a form of a horizontal concrete element projecting outwardly from a vertical concrete element a plurality of rows of assembled vertical studs, and varying the spacing of such assembled studs within a given row at the construction site to achieve optimal positioning of the studs with respect to the steel reinforcement before the concrete is poured and then pouring the concrete to form the vertical-horizontal connection.

20. The method set forth in claim 19 including the step of shipping the studs to the construction site unassembled and in bulk.

21. The method set forth in claim 19 including the step of varying the length of the rows at the construction site.

22. The method set forth in claim 19 including the step of forming the assembled row by sliding the studs into a channel.

23. The method set forth in claim 22 including the step of placing the shank of the stud in a selected spring loaded pocket.

24. The method set forth in claim 22 including the step of axially moving the stud with respect to the channel at a selected stud location to cause the channel frictionally to grip the stud at such selected location.

25. A method of forming a vertical-horizontal concrete element steel reinforced concrete connection in poured-in-place concrete structures comprising the steps of including in a form of a horizontal concrete element projecting outwardly from a vertical concrete element a plurality of rows of assembled vertical studs, and varying the spacing of such assembled studs within a given row at the construction site to achieve optimal spacing of the studs with respect to the steel reinforcement before the concrete is poured, securing the studs to a channel at the construction site at the desired spacing and length to form the row of assembled studs, and then using the channel as a holder, placing the assembled stud rows to face downwardly through the steel reinforcement at the vertical-horizontal concrete element connection before the connection is poured, and then pouring the concrete to form the vertical-horizontal connection.

26. The method set forth in claim 25 including the step of placing the studs in a spacing template channel to set the spacing of the studs, and then sliding a locking channel over the studs to form the assembly.

27. The method set forth in claim 25 including the step of field breaking the channel to a selected length before assembling the studs thereto at a selected spacing.

* * * * *